US006801075B2

(12) United States Patent
Gammie et al.

(10) Patent No.: US 6,801,075 B2
(45) Date of Patent: Oct. 5, 2004

(54) METHOD AND CIRCUIT FOR BASE CURRENT COMPENSATION

(75) Inventors: David A. Gammie, Tucson, AZ (US); Jeffery B. Parfenchuck, Tucson, AZ (US); Jerry L. Doorenbos, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/263,262

(22) Filed: Oct. 2, 2002

(65) Prior Publication Data

US 2003/0189459 A1 Oct. 9, 2003

Related U.S. Application Data

(60) Provisional application No. 60/367,850, filed on Mar. 27, 2002.

(51) Int. Cl.[7] ..... G06G 7/14
(52) U.S. Cl. ..... 327/362
(58) Field of Search ..... 327/362, 538

(56) References Cited

U.S. PATENT DOCUMENTS 4,263,562 A * 4/1981 Seiler ..... 330/257
4,345,216 A * 8/1982 Schade, Jr. ..... 330/288
4,471,321 A * 9/1984 Bowers ..... 330/261
4,757,274 A * 7/1988 Bowers ..... 330/257
5,157,322 A * 10/1992 Llewellyn ..... 323/315
5,382,917 A * 1/1995 Miyake et al. ..... 330/255
5,617,056 A * 4/1997 Main et al. ..... 327/538
6,204,719 B1 * 3/2001 Gilbert ..... 327/349

* cited by examiner

*Primary Examiner*—Terry D. Cunningham
(74) *Attorney, Agent, or Firm*—W. Danial Swayze, Jr.; W. James Brady; Frederick J. Telecky, Jr.

(57) ABSTRACT

A base current compensation circuit is configured for injecting base current to the base of a transistor device to compensate for the lost current demanded by a transistor base. The base current compensation circuit is configured to inject current into the base of the transistor without the headroom requirements, as well as being less complex than other approaches. An exemplary base current compensation circuit comprises a sampling circuit and a current mirror feedback circuit configured for providing multiples of the base current demanded by the transistor device.

12 Claims, 2 Drawing Sheets

METHOD AND CIRCUIT FOR BASE CURRENT COMPENSATION

CROSS-REFERENCE TO RELATED APPLICATIONS

This application claims priority of U.S. Provisional Application No. 60/367,850, filed Mar. 27, 2002, entitled "BASE CURRENT COMPENSATION CIRCUIT."

FIELD OF INVENTION

The present invention relates to amplifier circuits. More particularly, the present invention relates to a base current compensation circuit for use in an amplifier circuit.

BACKGROUND OF THE INVENTION

The increasing demand for higher performance amplifier circuits has resulted in the continued improvement of the precision and accuracy of the various devices and components within the amplifier circuits, as well the inclusion of additional buffers and compensation circuits.

In the implementation of various amplifier circuits, losses in the integrity of referenced currents flowing through the various devices and components can be realized. As a result, the delivered current can be less than the intended current to be provided from the amplifier circuit. One problem that can cause losses in the integrity results from the absorption of base current that is demanded from transistor devices by other devices within the amplifier circuit.

For example, with reference to FIG. 1, a circuit 100 comprising a differential pair of transistors $Q_1$ and $Q_2$, such as may be used within a logarithmic amplifier circuit, are illustrated. A first reference current $I_{C1}$ is provided to the collector of transistor $Q_1$, while a second reference current $I_{C2}$ is provided to the collector of transistor $Q_2$. It is desirable for a base current $I_{B1}$ demanded by transistor $Q_1$ to be provided without loss, such that a lost current $I_{LOST}$ equals zero. However, prior art amplifier circuits unfortunately are not able to provide the base current without loss. As a result, lost current $I_{LOST}$ can also generate error voltages that create an output error for amplifier circuit 100.

One approach for compensating for lost current $I_{LOST}$ includes the use of an isolating buffer that creates an additional current for supplementing the lost current $I_{LOST}$ and that is provided at the base of the transistor $Q_1$. However, such isolating buffer applications are generally more complex than desired. With reference to FIG. 2, another approach includes the implementation of a current mirror comprising diode-connected transistor $Q_3$ and transistor $Q_4$ configured to approximately provide the base current $I_{B2}$ from the base of transistor $Q_2$ to the base of transistor $Q_1$, wherein transistors $Q_1$ and $Q_2$ are matched, and transistors $Q_3$ and $Q_4$ are matched. However, this approach requires significant headroom since the input current into the collector of transistor $Q_2$ requires the voltage at the collector of transistor $Q_2$ to be at least a base-emitter voltage drop $V_{BE}$ above the voltage at the base of transistor $Q_1$. For many amplifier circuits, such as logarithmic amplifier circuits, it is desirable for the voltage at the collector of transistor $Q_2$ be equal to the voltage at the base of transistor $Q_1$.

Accordingly, a need exists for addressing the lost base current resulting within amplifier circuits.

SUMMARY OF THE INVENTION

In accordance with various aspects of the present invention, a base current compensation circuit is configured for injecting base current to the base of a transistor device to compensate for the lost current demanded by a transistor base. The base current compensation circuit is configured to inject current into the base of the transistor without the headroom requirements, as well as being less complex than other approaches.

In accordance with an exemplary embodiment, a base current compensation circuit comprises a sampling circuit configured for sampling current from the transistor device, and for providing multiples of the base current demanded by the transistor device. The sampling circuit can comprise a first sampling component for sampling current comprising a collector current proportional to the collector current of the transistor device. The sampled collector current can be configured through a second sampling component into a sampled base current proportional to the base current demanded by the transistor device. The sampled base current can then be provided to the base of the transistor device to compensate for current lost at the base. Base current compensation circuit can also comprise a current mirror circuit coupled between the first sampling component and the second sampling component for facilitating the sampling functions.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

The present invention may be described herein in terms of various functional components. It should be appreciated that such functional components may be realized by any number of hardware or structural components configured to perform the specified functions. For example, the present invention may employ various integrated components, such as buffers, current mirrors, and logic devices comprised of various electrical devices, e.g., resistors, transistors, capacitors, diodes and the like, whose values may be suitably configured for various intended purposes. In addition, the present invention may be practiced in any integrated circuit application. For purposes of illustration only, exemplary embodiments of the present invention will be described herein in connection with logarithmic amplifiers. Further, it should be noted that while various components may be suitably coupled or connected to other components within exemplary circuits, such connections and couplings can be realized by direct connection between components, or by connection through other components and devices located thereinbetween.

As discussed above, prior art base current compensation methods require significant headroom and/or are too complex. However, in accordance with various aspects of the present invention, a base current compensation circuit is configured for injecting base current to the base of a transistor device to compensate for the lost current demanded by the transistor base.

In accordance with an exemplary embodiment, a base current compensation circuit comprises a sampling circuit configured for sampling current from a transistor device, and for providing multiples of the base current demanded by the transistor device. An exemplary sampling circuit can comprise a first sampling component for sampling current comprising a collector current proportional to the collector current of the transistor device. The sampled collector current can be configured through a second sampling component into a sampled base current proportional to the base current demanded by the transistor device. The sampled base current can then be injected into the base of the transistor device to compensate for current lost at the base. For facilitating the sampling functions, base current compensation circuit can also comprise a current mirror circuit coupled between the first sampling component and the second sampling component.

Figure 1:
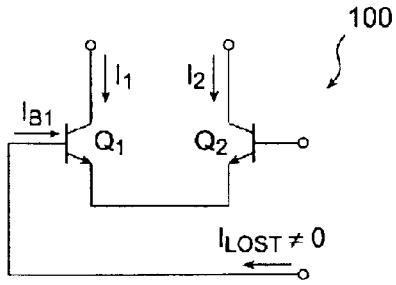
FIG. 1 (PRIOR ART)
FIG. 1 illustrates a schematic diagram of a prior art circuit without base current compensation.
Figure 2:
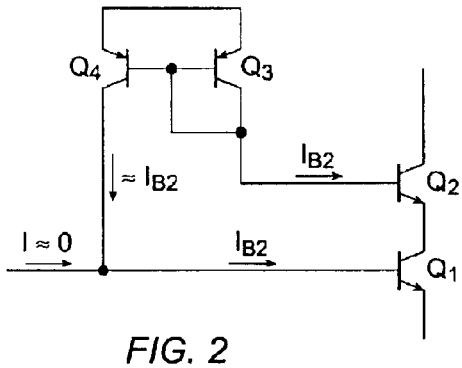
FIG. 2 (PRIOR ART)
FIG. 2 illustrates a schematic diagram of a prior art approach for base current compensation.
Figure 3:
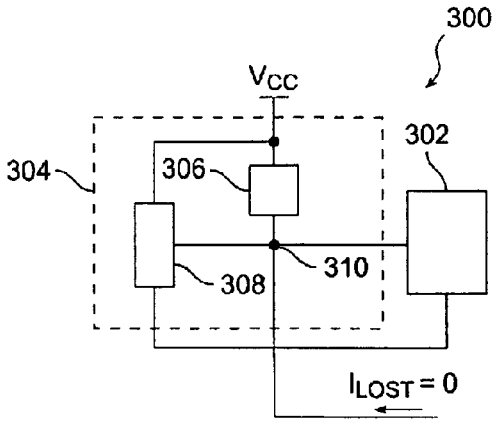
FIG. 3 illustrates a block diagram of an exemplary base current compensation circuit in accordance with an exemplary embodiment of the present invention.

With reference to FIG. 3, a circuit 300 comprises an amplifier circuit 302 and a base current compensation circuit 304. Amplifier circuit 302 suitably comprises any conventional amplifier circuit, including a logarithmic amplifier circuit, differential amplifiers, or various other amplifier configurations. Amplifier circuit 302 comprises one or more transistors, with the transistors demanding a base current to be provided without loss.

Base current compensation circuit 304 is configured to inject current into the base of one or more transistors of amplifier circuit 302 to compensate for any losses; however, base current compensation circuit 304 can be provided without the headroom requirements, as well as being less complex, of other prior art approaches for compensating for lost base current provided to the base of transistors within amplifier circuit 302.

In accordance with an exemplary embodiment, base current compensation circuit 304 comprises a sampling circuit 308 for compensating for any lost current demanded at the base of at least one transistor within amplifier circuit 302. Sampling circuit 308 can comprise a first sampling component and a second sampling component. The first sampling component is configured for sampling a collector current proportional to the collector current of a transistor device of amplifier circuit 302. The sampled collector current can be configured through the second sampling component into a sampled base current proportional to the base current demanded by the transistor device of amplifier circuit 302. In the exemplary embodiment, sampling circuit 308 is coupled to a supply voltage $V_{CC}$ and to a compensation node 310 that is configured to provide a base current $I_B$ to amplifier circuit 302. Through operation of sampling circuit 308, compensation current can be injected into compensation node 310 such that base current $I_B$ provided to amplifier circuit 302 is without loss, i.e., a lost current $I_{LOST}=0$.

For facilitating operation of sampling circuit 308, including the injection of compensation current into compensation node 310, base current compensation circuit 304 can also comprise a current mirror circuit 306 coupled between the first sampling component and the second sampling component. In the exemplary embodiment, current mirror circuit 306 is coupled to supply voltage $V_{CC}$ and to compensation node 310. Current mirror circuit 306 can be coupled directly to compensation node 310, or through the first sampling component. Current mirror circuit 306 can also comprise various current mirror configurations.

Base current compensation circuit 304 can be configured in various manners. For example, rather than a single sampling circuit, or a single current mirror circuit and a sampling circuit, a plurality of current mirror circuits and/or sampling circuits can be provided. Further, the configuration of current mirror circuits and sampling circuits can be provided in various manners.

Figure 4:
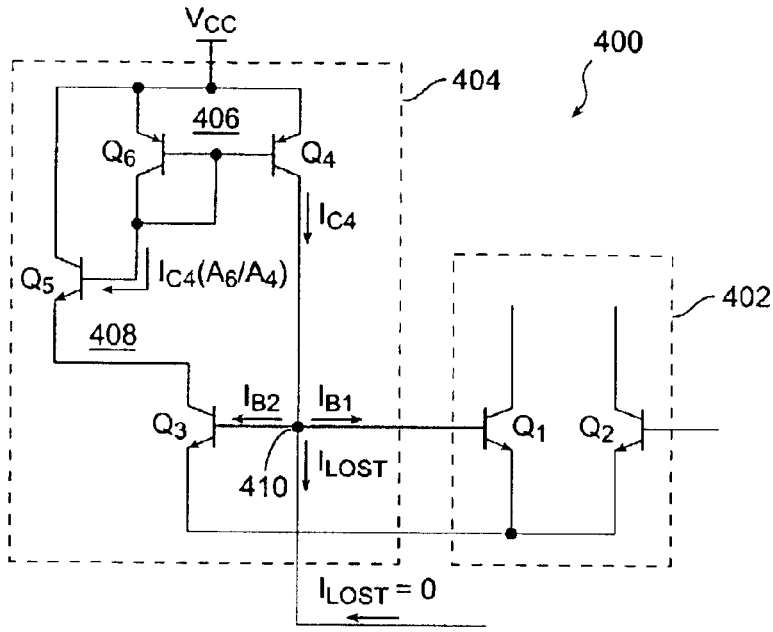
FIG. 4 illustrates a schematic diagram of an exemplary base current compensation circuit in accordance with an exemplary embodiment of the present invention.

For example, with reference to FIG. 4, an amplifier circuit 400 comprises a base current compensation circuit 404 configured with an amplifier circuit 402. Amplifier circuit 402 comprises a differential pair of transistors $Q_1$ and $Q_2$, such as may be used within a logarithmic amplifier circuit. Transistor $Q_1$ is configured to receive base current $I_{B1}$ without loss through compensation of base current compensation circuit 404.

Base current compensation circuit 404 is coupled to transistor $Q_1$ and configured to facilitate the appropriate injection of current into the base of transistor $Q_1$ to compensate for lost current such that the effective lost current $I_{LOST}$ at the base of transistor $Q_1$ equals zero.

In the exemplary embodiment, base current compensation circuit 404 comprises a current mirror circuit 406 and a sampling circuit 408. Current mirror circuit 406 is configured for facilitating injection of a compensated base current $I_{B1}$ to the base of transistor $Q_1$ to compensate for lost current at the base of transistor $Q_1$ such that the effective lost current $I_{LOST}$ equals zero. Current mirror circuit 406 comprises a pair of transistors $Q_4$ and $Q_6$, wherein transistor $Q_6$ comprises a diode-connected device. The emitters of transistors $Q_4$ and $Q_6$ are coupled to a supply voltage $V_{CC}$. The collector of transistor $Q_4$ is coupled to a compensation node 410 at the base of transistor $Q_1$, and mirrors a current $I_{C4}$ for injecting into compensation node 410.

Sampling circuit 408 includes a first sampling component comprising a transistor $Q_3$ and a second sampling component comprising a transistor $Q_5$. First sampling component $Q_3$ is configured for sampling a collector current proportional to the collector current of transistor $Q_1$, while second sampling component $Q_5$ is configured for sampling a base current proportional to the base current of transistor $Q_1$, i.e., comprising a multiple of the base current $I_{B1}$.

To sample the collector current of transistor $Q_1$, transistor $Q_3$ comprises a base coupled to compensation node 410, i.e., coupled to the base of transistor $Q_1$, and an emitter coupled to an emitter of transistor $Q_1$. Transistor $Q_5$ is coupled between transistor $Q_6$ and transistor $Q_3$. Transistor $Q_5$ has a base coupled to the collector of diode-connected transistor $Q_6$, and an emitter coupled to the collector of transistor $Q_3$.

For a lost current $I_{LOST}$ equal to zero, the current $I_{C4}$ at the collector of transistor $Q_4$ will equal the sum of currents $I_{B1}$ and $I_{B3}$, i.e., $I_{C4}=I_{B1}+I_{B3}$. In addition, the current at the collector of transistor $Q_6$ provided to the base of transistor $Q_5$ comprises approximately the current $I_{C4}$ at the collector of transistor $Q_4$, depending on the ratios of the areas of transistors $Q_4$ and $Q_6$, i.e., $I_{C4}$ $(A_6/A_4)$. Accordingly, the current $I_{C4}$ at the collector of transistor $Q_4$ can be configured for providing multiples of the base current $I_{B1}$ demanded by transistor $Q_1$, as recognized by the equation:

$$I_{C4}=I_{B1}*[(\beta_3*A_3*A_4)/(\beta_5*A_1*A_6)]$$

wherein $A_1$, $A_3$, $A_4$ and $A_6$ represent the areas of transistors $Q_1$, $Q_3$, $Q_4$ and $Q_6$, respectively. Further, with transistors $Q_3$ and $Q_5$ configured with substantially matched betas $\beta_3$ and $\beta_5$, the current $I_{C4}$ at the collector of transistor $Q_4$ can be suitably configured to provide the desired current at the base of transistor by suitably scaling the areas of transistors $Q_1$, $Q_3$, $Q_4$ and $Q_6$:

$$I_{C4}=I_{B1}*[(A_3*A_4)/(A_1*A_6)]$$

Accordingly, the device areas can be suitably scaled in any manner for providing a compensated current for injecting into compensation node 410 such that the effective lost current $I_{LOST}$ approaching the base of transistors $Q_1$ and $Q_3$ equals zero.

While the above embodiment is illustrated with the base of transistor $Q_1$, base current compensation circuit 404 can also be configured to compensate for the base current at transistor $Q_2$, or for both transistors $Q_1$ and $Q_2$. Further, in accordance with other exemplary embodiments, amplifier circuits can be configured with a plurality of base current compensation circuits for compensating for the base current for a plurality of transistors. Still further, base current compensation circuit 404 can be provided with other sampling circuit configurations.

Figure 5:
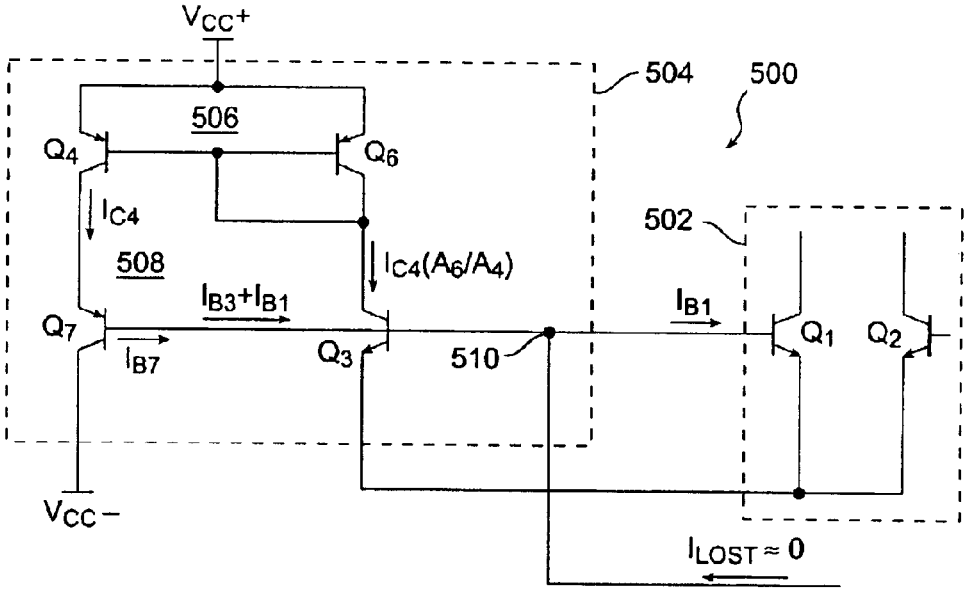
FIG. 5 illustrates a schematic diagram of an exemplary base current compensation circuit in accordance with another exemplary embodiment of the present invention.

For example, with reference to FIG. 5, an amplifier circuit 500 comprises a base current compensation circuit 504 comprising a current mirror circuit 506 and a sampling circuit 508. Sampling circuit 508 includes a first sampling component comprising transistor $Q_3$ and a second sampling component comprising transistor $Q_7$.

Transistor $Q_3$ is configured to sample the collector current of transistor $Q_1$. Transistor $Q_3$ has an emitter coupled to an emitter of transistor $Q_1$, and a base coupled to a compensation node 510, i.e., coupled to the base of transistor $Q_1$. Transistor $Q_3$ also has a collector coupled to the collector of diode-connected transistor $Q_6$, and thus receives the mirror current $I_{C4}$ $(A_6/A_4)$.

Transistor $Q_7$ is coupled to transistor $Q_1$ and configured to sample multiples of the base current of transistor $Q_1$ to facilitate the appropriate injection of compensation current into the base of transistors $Q_1$. Transistor $Q_7$ comprises an emitter coupled to the collector of transistor $Q_4$, a collector coupled to the negative rail $V_{CC}^-$, and a base coupled to the base of transistor $Q_3$ at compensation node 510, i.e., coupled to the base of transistor $Q_1$.

Current mirror circuit 506 mirrors sampled collector current from transistor $Q_3$ to the emitter of transistor $Q_7$ to provide a sampled base current to compensation node 510. Similar to base current compensation circuit 504, the device areas of transistors $Q_3$, $Q_4$, $Q_6$, and $Q_7$ can be suitably scaled in any manner for providing a compensated current for injecting into compensation node 510 such that the effective lost current $I_{LOST}$ approaching the base of transistors $Q_1$ and $Q_3$ equals zero.

Accordingly, a base current compensation circuit can be configured in various manners for injecting a compensation current to the base of transistors within an amplifier circuit, thus resulting in minimal current loss at the base of the transistors.

The present invention has been described above with reference to various exemplary embodiments. However, those skilled in the art will recognize that changes and modifications may be made to the exemplary embodiments without departing from the scope of the present invention. For example, the various exemplary embodiments can be implemented with other types of circuits in addition to those illustrated above. These alternatives can be suitably selected depending upon the particular application or in consideration of any number of factors associated with the operation of the system. Moreover, these and other changes or modifications are intended to be included within the scope of the present invention, as expressed in the following claims.

What is claimed is:

1. An integrated circuit comprising:

a supply voltage terminal;

an amplifier circuit comprising at least one transistor having a base terminal configured to receive a base current; and a base current compensation circuit coupled to said supply voltage terminal and said amplifier circuit, said base current compensation circuit configured for compensation of losses in said base current of said at least one transistor through injection of a compensation current at a compensation node coupled to said base terminal.

wherein said base current compensation circuit a curent mirror circuit and a sampling circuit wherein said current mirror circuit comprises a pair of transistors, with a first transistor of said pair of transistors comprising a diode-connected transistor and a second transistor of said pair of transistors having a collector coupled to said base terminal, wherein said sampling circuit comprises a first sampling component and a second sampling component, said first sampling component comprising a first transistor having a base terminal coupled to said base terminal of said at least one transistor of said amplifier circuit, and an emitter terminal coupled to an emitter terminal of said at least one transistor of said amplifier circuit, and wherein said second sampling component comprises a second transistor having an emitter coupled to a collector of said second transistor of said current mirror circuit, a base coupled to said base terminal of said amplifier circuit, and a collector coupled to a negative supply voltage terminal.

2. The integrated circuit of claim 1, wherein said base current compensation circuit comprises:

a current mirror circuit coupled between said supply voltage terminal and said amplifier circuit; and a sampling circuit coupled to said compensation node to inject said compensation current, said sampling circuit comprising a first sampling component and a second sampling component, said first Sampling component configured for sampling collector current of said at least one transistor device of said amplifier circuit, and said second sampling component configured for sampling base current of said at least one transistor device of said amplifier circuit.

3. The integrated circuit of claim 1, wherein said base current compensation circuit is configured for providing multiples of said base current that is demanded by said at least one transistor.

4. The integrated circuit of claim 3, wherein said base current compensation circuit is configured for providing multiples of said base current through scaling of device areas of transistors within said base compensation circuit and said at least one transistor of said amplifier circuit.

5. The integrated circuit of claim 1, wherein said amplifier circuit comprises a differential pair of transistors.

6. The integrated circuit of claim 1, wherein said amplifier circuit comprises a logarithmic amplifier circuit.

7. The integrated circuit of claim 1, wherein said integrated circuit comprises a plurality of base current compensation circuits.

8. An amplifier circuit configured with a base current compensation circuit for reducing losses in the base current of a transistor in said amplifier circuit, said base current compensation circuit comprising:

a current mirror circuit coupled to said amplifier circuit;

a sampling circuit configured to sample multiples of the base current for injecting a compensation current, said sampling circuit coupled with said current mirror circuit to said amplifier circuit, said sampling circuit comprising a first sampling component and a second sampling component; and a compensation node coupled to a base terminal of the transistor of said amplifier circuit, wherein said base current compensation circuit is configured for compensation of tosses in said base current through injection of said compensation current into said compensation node, wherein said current mirror circuit comprises a first transistor and a second transistor, said first transistor comprising a diode-connected transistor and said second transistor having a collector coupled to a base terminal of said amplifier circuit, wherein said first sampling component comprises a third transistor having a base terminal coupled to said base terminal of the transistor of said amplifier circuit, and an emitter terminal coupled to the emitter terminal of the transistor of said amplifier circuit, wherein said second sampling component comprises a fourth transistor having a collector configured to receive a supply voltage, a base coupled to a collector terminal of said first transistor, and an emitter coupled to a collector of said third transistor, and wherein said second sampling component comprises a fourth transistor having an emitter coupled to said collector of said second transistor, a base coupled to said base terminal of said third transistor, and a collector coupled to a negative supply voltage terminal.

9. The amplifier circuit of claim 8, wherein said first sampling component is configured for sampling collector current of the transistor of said amplifier circuit, and said second sampling component is configured for sampling base current of the transistor of said amplilier circuit.

10. The amplifier circuit of claim 9, wherein said base current compensation circuit is configured for providing multiples of said base current through scaling of device areas of transistors within said base compensation circuit and said amplifier circuit.

11. The amplifier circuit of claim 8, wherein said amplifier circuit comprises a logarithmic amplifier circuit.

12. A base current compensation circuit for compensating for losses in base current in a transistor in an amplifier circuit, said base current compensation circuit comprising:

a sampling circuit configured to sample multiples of the base current for injecting a compensation current, said sampling circuit comprising a first sampling component for sampling and a second sampling component, said first sampling component configured for sampling collector current of the transistor of the amplifier circuit, and said second sampling component is configured for sampling base current of the transistor of the amplifier circuit; and wherein said base current compensation circuit is configured for compensation of losses in the base current through injection of a compensation current into a compensation node, wherein said first sampling component comprises a first transistor having a base terminal configured for coupling into a base terminal of the transistor of the amplifier circuit, and an emitter terminal configured for coupling into an emitter terminal of the transistor of the amplifier circuit, and wherein said second sampling component comprises a second transistor having a base coupled to a base terminal of said first transistor of said first sampling component, and a collector coupled to a negative supply voltage terminal.

* * * * *